US008218283B2

(12) United States Patent
Tageman

(10) Patent No.: US 8,218,283 B2
(45) Date of Patent: Jul. 10, 2012

(54) RESISTIVE FILMS FOR ELECTRODE PEAK-FIELD SUPPRESSION

(75) Inventor: Ola Tageman, Göteborg (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 1005 days.

(21) Appl. No.: 11/995,396

(22) PCT Filed: Jul. 15, 2005

(86) PCT No.: PCT/SE2005/001161

§ 371 (c)(1),
(2), (4) Date: Jul. 8, 2008

(87) PCT Pub. No.: WO2007/011270

PCT Pub. Date: Jan. 25, 2007

(65) Prior Publication Data

US 2008/0297969 A1 Dec. 4, 2008

(51) Int. Cl.
*H01H 47/00* (2006.01)

(52) U.S. Cl. ..... 361/220

(58) Field of Classification Search ..... 361/220
See application file for complete search history.

(56) References Cited

U.S. PATENT DOCUMENTS

| | | | | |
|---|---|---|---|---|
| 3,163,851 | A * | 12/1964 | Tummers et al. | 365/175 |
| 3,227,975 | A * | 1/1966 | Hewlett et al. | 333/81 A |
| 4,147,409 | A * | 4/1979 | Apfel | 359/584 |
| 4,272,739 | A * | 6/1981 | Nesses | 333/81 A |
| 4,309,677 | A | 1/1982 | Goldman | |
| 5,039,961 | A | 8/1991 | Veteran | |
| 5,747,829 | A * | 5/1998 | Sakurai et al. | 257/66 |
| 5,977,606 | A * | 11/1999 | Sakurai et al. | 257/507 |
| 2002/0130358 | A1 * | 9/2002 | Van Dalen et al. | 257/328 |

FOREIGN PATENT DOCUMENTS

| | | |
|---|---|---|
| EP | 0 608 889 A1 | 8/1994 |
| JP | 9219607 | 8/1997 |

* cited by examiner

*Primary Examiner* — Ronald W Leja

(57) ABSTRACT

The present invention relates to an arrangement comprising at least one high potential electrode with a high potential in terms of absolute value, e.g. comprising substantially sharp edges and which may be exposed to a high electrostatic field or a high potential. It comprises at least one low potential electrode means or balancing electrode Q mean said low or balancing potential electrode means being provided at a distance from said at least one high potential electrode and at least one resistive arrangement connecting each of said high potential electrode(s) with each respective Q adjacent low or balancing potential electrode means. Said resistive arrangement(s) has a low conductivity but Q is non-isolating, such that a substantially linear voltage drop is provided between said high potential electrode(s) and said low or balancing potential electrode(s) to suppress peak-fields generated in the vicinity of any of the electrode(s).

31 Claims, 6 Drawing Sheets

RESISTIVE FILMS FOR ELECTRODE PEAK-FIELD SUPPRESSION

FIELD OF THE INVENTION

The present invention relates to an arrangement comprising at least one high electrostatic potential electrode which e.g. may have substantially sharp edges. Particularly the high potential electrode is adapted to be exposed to a high potential or it is an electrode intentionally or unintentionally exposed to a high electrostatic field producing a high potential. The invention also relates to use of the arrangement in for example a ferroelectric device such as for example a phase shifter, a filter, a matching circuit, an antenna, a controllable antenna, a power splitter or similar.

STATE OF THE ART

For high voltage arrangements in general the design of the electrodes is extremely important. If they are not designed properly or located properly, there is a high risk for arching in the air around the electrodes, discharging, and for example dielectric break-down in surrounding materials or substrate materials carrying the electrodes. If dielectric materials are carrying the electrodes, a dielectric break-down may occur in the substrate material. Air as a surrounding material for example supports about 3-5V/μm. For so called planar electrodes the situation is particularly troublesome since a high voltage on planar electrodes gives rise to high peak-fields near the edges. If the electrodes are located at an interface between two materials with different or very dissimilar permittivities, the peak-fields will typically be even higher.

Different solutions have been proposed to solve the problems referred to above. According to one approach high voltage electrodes are encapsulated in silicone so that there will be no air in the immediate vicinity of the electrode edges. However, if electrodes are provided on a dielectric substrate or a dielectric layer, silicone encapsulation will provide for an increase in the dielectric strength above the substrate, but it has no effect inside the substrate. According to another approach, the device is immersed in an isolation fluid, but such a solution suffers from the same disadvantages as encapsulation in silicone.

According to a third approach, large isolation distances between the electrodes are used. This may of course reduce the fields, and it will give a larger creep distance for the current. However, in many cases large fields are desirable in order for example to provide a good performance of the arrangement and this inevitably leads to strong fields near the electrodes in any case.

Still further, another solution is suggested according to which all constituent parts, particularly the electrodes, are made as round as possible, i.e. they are rounded and it is tried to avoid sharp edges. In principle this is an attractive solution since the fields are reduced. However, in many cases it is very difficult and expensive to fabricate rounded electrodes. In addition thereto, in cases when the electrodes are provided on dielectric layers, when the permittivity of the dielectric layer or the substrate is very high, it will be necessary to insert the rounded electrodes half way into the dielectric layer substrate if the rounding is to have a positive effect on the peak fields (in ferroelectric devices allowing controllability of the dielectric constant by means of for example a controlled applied voltage, the permittivity is typically in the range of 100-3000 although it may also be much higher, e.g. up to 20000).

SUMMARY OF THE INVENTION

What is needed is therefore an arrangement as initially referred to through which the risk of arching, discharging, and dielectric break-down (if applicable) around the high potential or high voltage electrodes can be reduced or eliminated. Particularly an arrangement is needed through which singularities in the field produced around high potential electrodes can be suppressed or reduced. Particularly high voltage arrangements are needed through which the peak-fields around or associated with sharp edge electrodes can be reduced, but also for cases when rounded electrodes are not inserted to some extent into a dielectric material as discussed above. Further yet an arrangement is needed wherein high peak-fields, dischargings etc. can be avoided particularly for planar implementations with planar electrodes and planar substrates and/or electrically controllable layers. Even more particularly an arrangement as initially referred to is needed through which peak-fields etc. can be suppressed or reduced and dielectric break-down can be prevented when the electrodes are provided on a dielectric substrate material, where the substrate material can be electrically controllable. Particularly an arrangement as initially referred to is needed which is electrically controllable through the application of an electrostatic field, e.g. by variation of the dielectric constant of a ferroelectric material, through which the above mentioned disadvantages can be reduced or eliminated to a high extent. Particularly a high voltage arrangement is needed in which peak-fields and field singularities etc. can be reduced even if applying a high electro-static field (intentionally, but also for unintentional exposure).

Particularly it is an object of the present invention to provide an arrangement through which it gets possible to set up an electrostatic field which is as high as possible in ferroelectric devices without facing reliability problems among others due to dielectric break-down in a ferroelectric material. Particularly it is an object to prevent peak-fields irrespectively of whether a high voltage is applied voluntarily or involuntarily, i.e. to provide a solution to the problems produced by high electrostatic fields in general. Most particularly it is an object to provide an arrangement wherein the electrodes are placed at an interface between two materials with dissimilar permittivities through which peak-fields can be reduced to a high extent. Particularly an arrangement is needed through which, in case the electrodes are provided on a dielectric substrate, the produced fields can be affected, and reduced, also inside the substrate in order to protect the substrate, or the ferroelectric layer, when the arrangement, or the electrodes are exposed to a high electrostatic field. An arrangement is also needed which supports application of large electric fields in order to provide a good performance. Furthermore an arrangement is needed which is easy to fabricate and which is reliable. Particularly it is an object to be able to build components such as controllable antennas, phase shifters, filters, impedance matching networks, power splitters etc. which support high fields, are resistant to ageing, are reliable and particularly are electrically controllable or tunable.

Therefore an arrangement as initially referred to is provided with at least one low potential electrode means, or at least one electrode means having a potential which is such in relation to said at least one high potential electrode (in absolute value (+/−)) or relative to a reference potential or background (e.g. ground) potential, that the potential will be balanced, said low potential or balancing electrode means being disposed at a distance from said at least one high potential electrode or at least partly surrounding said at least one high potential electrode, and at least one resistive arrangement connecting each said high potential electrode with each respective adjacent low or balancing potential electrode, whereby said resistive arrangement has a low conductivity which however still is non-isolating, such that a substantially linear voltage drop is provided between said high potential electrode or electrodes and said low or balancing potential electrode or electrodes in order to suppress peak-fields or field singularities near the (possibly sharp) edges of the high potential electrodes.

In a particularly advantageous implementation the high potential electrode or electrodes are disposed on a dielectric layer with a variable dielectric constant allowing for electrically controlling or tuning of the arrangement. According to the invention, particularly the high potential electrode or electrodes, the low (or balancing) potential electrode or electrodes and the resistive film arrangement are provided on a ferroelectric layer, i.e. a dielectric layer with a variable and hence tunable or controllable dielectric constant. In such an embodiment the arrangement particularly comprises, or is connected to, an electric control means, comprising a voltage generating means or applying means adapted to apply an electric field to the ferroelectric layer in order to control or tune the dielectric constant.

In one embodiment at least the high potential electrode or electrodes are planar electrodes, in the sense that they are provided on a, at least locally, flat surface and where at least one electrode dimension is very thin compared to the other two, or one. If the high potential electrodes are provided on a ferroelectric material, i.e. a dielectric material with a variable dielectric constant, this ferroelectric material may comprises a ceramic material, for example a BST (Barium Strontium Titanate) material or a material with similar properties. In one implementation a ground electrode is provided on a side of the ferroelectric layer which is opposite to the side on which the high and low (balancing) potential electrodes are arranged. If the low or balancing potential electrode is not a ground electrode it is particularly at least an electrode having a potential which differs considerably from that of the high potential electrode or electrodes. The arrangement may comprise one, two or more high potential electrodes. If there are at least two high potential electrodes they may have the same potential but also different potentials, differing to a small extent or to a very large extent, or anything therebetween.

According to the invention the resistive arrangement may comprise a high resistivity film. The resistive arrangement, particularly the high resistivity film, but actually independently of which is the resistive arrangement, it can have different values of the (sheet) resistance for different applications, but a value in the range 1-10.000 MOhm/square should be adequate in most applications. In one implementation the resistive arrangement has a resistivity of about 50-150, particularly about 100 MOhm/square.

Particularly the resistivity of the material that is selected to be used in the resistive arrangement can be limited downwards by requirements concerning maximum power consumption and/or maximum allowable heating of the arrangement, at the maximum voltage to be used, and/or requirements as to transmissibility of microwaves, for some microwave implementations, and particularly it can be limited upwards by requirements as to fast reaction times at high voltages. It should be clear that the resistivity can be selected without being limited downwards/upwards as discussed above.

In particular implementations the resistive arrangement may consist of $SrTiO_3$ and $LaMnO_3$ films.

In some implementations the arrangement may comprise a thin film arrangement, i.e. produced using thin-film technology. In other implementations it may comprise an arrangement for example using "thick films" or a three-dimensional arrangement, where instead of a virtually two-dimensional film, a three-dimensional filling with a high, but finite conductivity is used around and between electrodes.

The resistive arrangement, particularly the resistive film in a thin-film application, may comprise Nichrome (NiCr), Cr, Ta, tantalum oxynitride, or tantalum nitride or a material with similar properties, and e.g. a material comprising metal particles in a dielectric matrix, e.g. of a Cr and Si monoxide mixture or a Cr—SiO material. These materials may particularly be applicable for thin film technologies whereas preferably $SrTiO_3$ and/or $LaMnO_3$ or other materials with similar properties may be used otherwise.

For a thick film implementation, the resistive arrangement may particularly have a thickness of about 5-10 μm and the electrodes may have a thickness of about 10 μm and be provided on a dielectric layer with a thickness approximately in the range 0.5-10 mm. It should be clear that the resistive arrangement may also be thicker than 10 μm, for example up to 50 μm or even more.

The arrangement may be a planar arrangement (with a resistive arrangement with a very high resistivity), both if it is a thick film arrangement or a thin-film arrangement.

According to some embodiments, the resistive arrangement is arranged in order to substantially surround the high potential electrodes (or the electrodes requiring balancing). In other embodiments the resistive arrangement is provided between the high potential electrode or electrodes and the low or balancing potential electrode or electrodes or it may be disposed such as to both surround and be provided inbetween high and low/balancing potential electrodes respectively.

In some implementations high potential as well as low or balancing potential electrodes may be located on two opposite sides of e.g. an electrically tunable dielectric material, i.e. two/multi-layer structures are also possible. Particularly the resistive arrangement is provided, on both opposite sides, between each high potential electrode and the adjacent respective low or balancing potential electrode or electrode arrangement respectively.

In alternative embodiments the resistive arrangement comprises deliberate leakage currents enabled to flow in an electrically controllable or tunable dielectric layer or any other substrate in non-controllable arrangements or in any other substrate if controllable. Alternatively silicone or an isolation fluid is provided to more or less cover the resistive arrangement.

The resistive arrangement at least to some extent, directly or indirectly, connects the low or balancing and high potential electrode(s). The resistive arrangement may also be in direct contact with the electrodes, or either low/balancing or high potential electrodes.

In order to still further improve the arrangement, the high potential electrode or electrodes may additionally be encapsulated in silicone or immersed in an isolation fluid as in conventional technologies. The arrangement may have an extension, which particularly is planar and/or which is circular, oval, square-shaped, rectangular or ellipsoidal, trapezoid- or irregularly shaped etc., in other words have any appropriate shape depending on application. The high and/or low (balancing) potential electrodes may be printed or sputtered/plated and etched in a dielectric layer, or some other appropriate substrate layer, acting solely as a substrate, or as an active layer in the sense that it provides for controllability. In particular implementations the at least two high potential electrodes are disposed at a distance from each other of approximately the order 0.1-10 mm, or e.g. a few μm:s, for example 3-30 μm or less, e.g. in thin film ferroelectric devices and integrated circuits, although also other distances of course can be used depending on which is the voltage that is applied or the voltage to which the electrodes are exposed.

It should be clear that the inventive concept covers cases when the electrodes (high and/or low and/or balancing) are provided on a substrate, e.g. ferroelectric, and when they are not, or some is/are not, and that a high potential (peak-field) may be generated, e.g. due to a high potential electrode, at a low or balancing potential electrode, and that, through the invention such peak-fields will be suppressed. It should also be clear that the concept is applicable in e.g. a high potential electrode, with or without sharp edges which e.g. also may be spheroidically shaped or have a substantially circular cross-section or any other shape, where there is a high potential or which produces a high potential somewhere else, e.g. in the vicinity of a low or balancing potential electrode.

The resistive arrangement, e.g. a film, may e.g. comprise $SrTiO_3$+$LaMnO_3$, cermets based on for example $RuRuO_2$, $PbRu_2O_7$ or $BiRuO_7$ or polymeric resistor materials, $BaPbO_3$, TaN, NiCr, CrSi, TaSi, TiW, Ruthenium or AgPt-based cermets.

As fabrication methods may e.g. sputtering, plating, screen-printing be used. The substrate, e.g. a dielectricum, may be ferroelectric ceramic material, $Al_3O_2$, AlN, LTCC (Low Temperature Cofired Ceramics), organic circuit boards etc.

The arrangement may particularly be used in ferroelectric based phase shifters, filters, matching circuits, controllable antennas, power splitters or similar.

BRIEF DESCRIPTION OF THE DRAWINGS

The invention will in the following be further described, in a non-limiting manner, and with reference to the accompanying drawings, in which.

DETAILED DESCRIPTION OF THE INVENTION

Figure 1A:
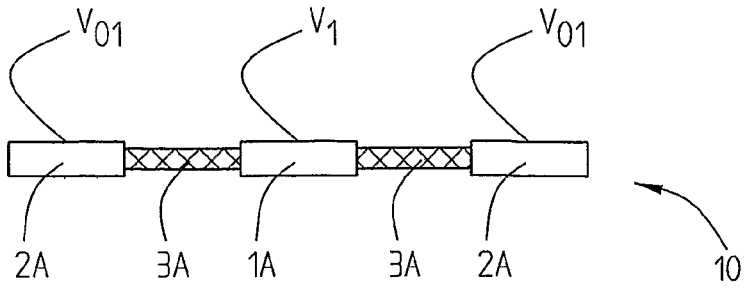
FIG. 1A very schematically illustrates a cross-sectional view of an arrangement according to one implementation of the invention.

FIG. 1A shows a basic implementation of the inventive concept with an arrangement 10 in which a circular disk shaped high potential electrode 1A with a potential $V_1$ is surrounded by, here, a ring shaped low potential electrode 2A which here has the potential $V_{01}$, which for example may be zero V or substantially ground. Between the high potential electrode 1A and the low potential electrode 2A a resistive arrangement 3A is provided. The separation between the high potential electrode and the low potential electrode should at least be such as to prevent dielectric breakdown in the air (about 3-5 kV/mm) supposing that the field is "evened out" due to the resistive arrangement. If silicon encapsulation additionally is implemented, the distance may be reduced e.g. about 2-5 times, the other materials hence forming the limiting factor.

Figure 1B:
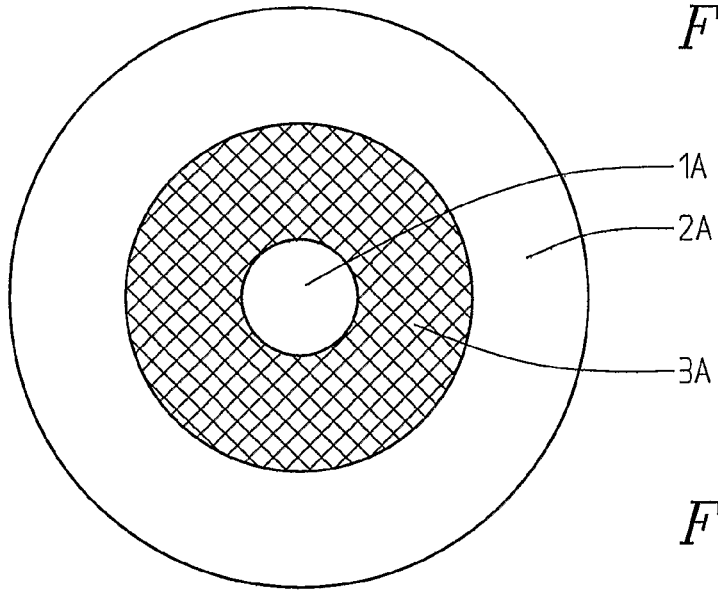
FIG. 1B is a schematical top view of the arrangement in FIG. 1A.

In other embodiments, as will be described further below, low potential electrodes may be provided also on only one side of a high potential electrode, or on two or three sides etc. depending on application and implementation. In this basic embodiment there is no substrate layer or additional layer on which the electrodes are disposed shown since it is actually not necessary for the functioning of the inventive concept which merely is based on there being one or more high voltage or high potential electrodes e.g. with substantially sharp edges such that there is a risk of high electrostatic peak fields being generated at the edges or that field singularities are produced around the electrodes. When reference is made to field singularities occurring, it should be noted that the problems may be produced in surrounding areas as well as any other adjacent material or substrate layer. For exemplifying reasons, the high voltages may relate to kV voltages over mm gaps but also higher voltages as well as lower voltages and in some implementations it may be as low as 20 or a few Volts but then over μm wide gaps. However, in cases in which a field or a potential is applied voluntarily, for example in order to make an arrangement controllable, it is often attractive to be able to use as high field strengths as possible in order to achieve a good performance and a good controllability. FIG. 1B is a top view of the arrangement in FIG. 1A.

Figure 2:
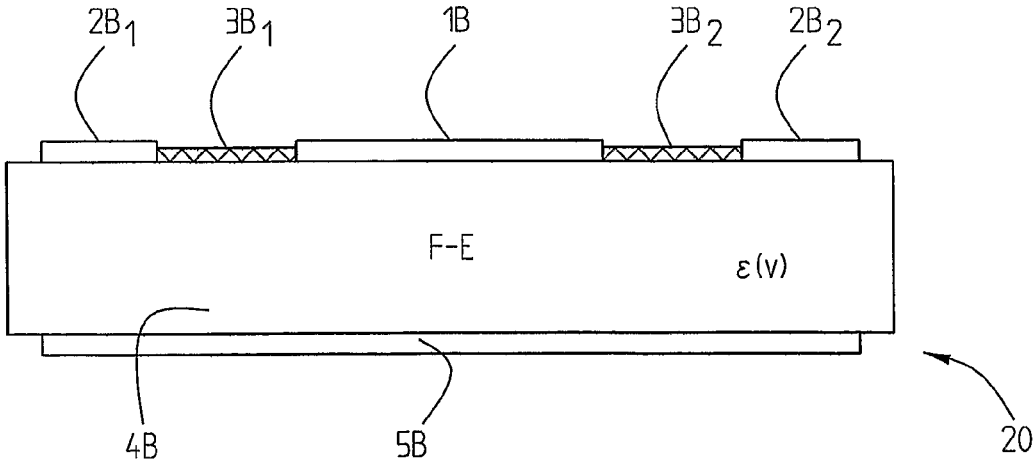
FIG. 2 is a cross-sectional view of an arrangement according to another embodiment in which a high potential electrode is disposed on a ferroelectric layer.

FIG. 2 shows an embodiment with an arrangement 20 according to the inventive concept in which a high voltage electrode or, more generally high voltage area 1B, which may comprise one or more electrodes, is provided on a dielectric material 4B, here a dielectric material with a controllable dielectric constant, i.e. where the dielectric constant which can be tuned by means of an applied electrostatic field. According to the invention high resistivity arrangements or connections $3B_1$, $3B_2$ are provided between different electrodes, here between the high voltage electrode 1B and the low potential electrodes $2B_1$, $2B_2$ which may have the same or different potentials, the main thing being that it is low, for example substantially ground, or such as to balance the high potential electrode 1B.

In the embodiment of FIG. 2, a so called planar technology has been used in order to implement the idea of connecting different high voltage electrodes. The planar ferroelectric layer 4B for example comprises ceramic on which conducting regions (the electrodes) and resistive regions (the resistive arrangement) are printed or sputtered/plated and etched. The high voltage or high potential electrode 1B has a high potential with reference to, here a ground plane 5B, on the opposite side or the backside of the ferroelectric layer 4B. In order to suppress the concentration of the electrical field around the edges of the high voltage electrodes or the electrodes of the high voltage area 1B, two low potential electrodes $\mathbf{2}B_1$, $\mathbf{2}B_2$, which may be grounded, are provided on two or more sides of the high potential electrode 1B on top of the ferroelectric layer 4B. The high resistivity arrangement $\mathbf{3}B_1$, $\mathbf{3}B_2$, which for example comprises a high resistivity film, connects the high potential electrode 1B to the low potential electrodes or the ground electrodes $\mathbf{2}B_1$, $\mathbf{2}B_2$. In this way it is provided for a steady transport of current which will assure there will be a linear voltage drop from the high potential electrode 1B to the low potential electrodes $\mathbf{2}B_1$, $\mathbf{2}B_2$. In that manner a concentration of the field near the high potential electrode 1B can be avoided which otherwise would have been the result. In one embodiment the resistive arrangement comprises a high resistivity film on the surface of the dielectric layer.

In other embodiments the resistive arrangement may comprise deliberate leakage currents provided in the substrate or ferroelectric layer itself or optionally in resistive silicone or resistive fluid that may be provided around the electrodes.

In one embodiment the thickness of the ferroelectric layer may be around 1 mm whereas the thickness of the electrodes may comprise about 10 μm. It should however be clear that these figures of course merely are given for exemplifying reasons. This embodiment shows an implementation based on planar technology but not implementing thin-film technology. It should be clear that the inventive concept is applicable also to other planar technologies, to thin-film technology based implementations etc, but also to non-planar technologies.

However, in this particular embodiment a resistivity of the order 100 MOhm/square is suitable. This is also merely an exemplifying value and depending on application much lower resistivities for example down to less than, or a few MOhms/square and up to one or more GOhms/square may also be used. Generally the lower limit of the resistivity in a resistive arrangement that is used for an application can be set depending on requirements on maximum DC-power consumption and/or requirements as to maximum heating of the arrangement and/or requirements as to whether it should be applicable for microwave applications, i.e. if it has to allow microwaves to penetrate. The upper limit may for example be set depending on requirements as to fast reaction times, making it capable to handle fast changes at high voltages.

Different materials can be used. As examples $SrTiO_3$ mixed with $LaMnO_3$ can be mentioned, for example 0.5 $SrTiO_3$, 0.5 $LaMnO_3$ as a screen printed with a thickness of about 10 μm and sintered at a high temperature, for example about 1200° C.

Also thin film technology can be used for the resistive films. One example of a suitable material could be Ni, Cr, for example Nichrome (80% Ni, 20% Cr).

In addition to Ni—Cr thin film resistor materials, Cr, Ta, tantalum oxynitride, tantalum nitride, and other materials could be used for the manufacture of thin-film resistive arrangements.

Other possible alternative materials that could be used in thin-film resistors are solid solutions of metal particles in a dielectric matrix, e.g. Cr and Si Monoxide mixtures.

Figure 3:
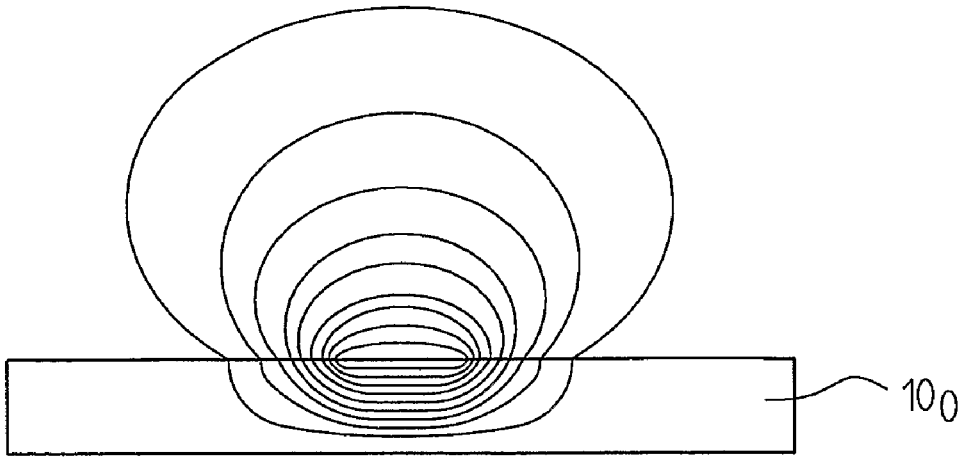
FIG. 3 illustrates simulated equi-potential lines for an arrangement according to the state of the art, corresponding to FIG. 2 but without resistive films and ground electrodes on top.

FIG. 3 shows simulated equi-potential lines for a state of the art arrangement $\mathbf{10}_0$ featuring only backside ground. It can be seen that the potential lines are concentrated close to the electrode edges which corresponds to a field concentration. In this plot there is a 10% difference in the potential between consecutive equi-potential lines.

Figure 4:
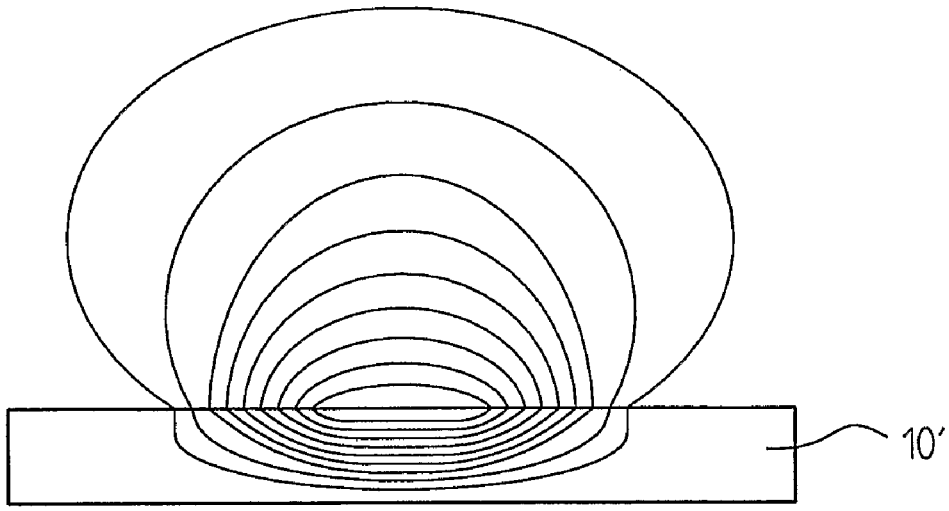
FIG. 4 is a figure similar to FIG. 3 illustrating simulated equi-potential lines for an arrangement according to one implementation of the inventive concept, e.g. corresponding to FIG. 2.

FIG. 4 is a figure similar to that of FIG. 3 but for an arrangement 10' according to the inventive concept in which low potential electrodes or ground electrodes are provided on either sides of a high potential electrode and between which and the high potential electrode a resistive arrangement is disposed as discussed above. (For reasons of clarity this is however not shown in this figure, but any one of the arrangements described herein might constitute arrangement 10'.) The distance between the potential lines will here be constant along the surface of the substrate. It is an extremely important advantage of the present invention that the singularities or peak-fields will be suppressed also inside the substrate (if such is provided). This is very critical for a long-term, high voltage reliability of the substrate.

It is extremely advantageous that through the implementation of the inventive concept the peak-fields around e.g. sharp edge electrodes, particularly planar electrodes, will be suppressed as well as, if such is provided, the peak-fields will be suppressed also inside and above a substrate which most particularly may be electrically controllable. This will have a substantial impact on the performance and reliability of such arrangements.

In different embodiments one or more of already known technologies may also be combined with the inventive concept in order to, for example, increase the dielectric strength above a substrate.

It should be clear that the inventive concept can be varied in many different manners, the main thing being the provisioning of a resistive connection to low (in terms of the absolute value) or with respect to, also high balancing, e.g. of opposite sign, potential electrodes that are used to provide a steady current from the high potential (in terms of an absolute value) electrode edges, and which forces the voltage to drop linearly.

In the following some examples will be briefly discussed with reference to the drawings.

Figure 5A:
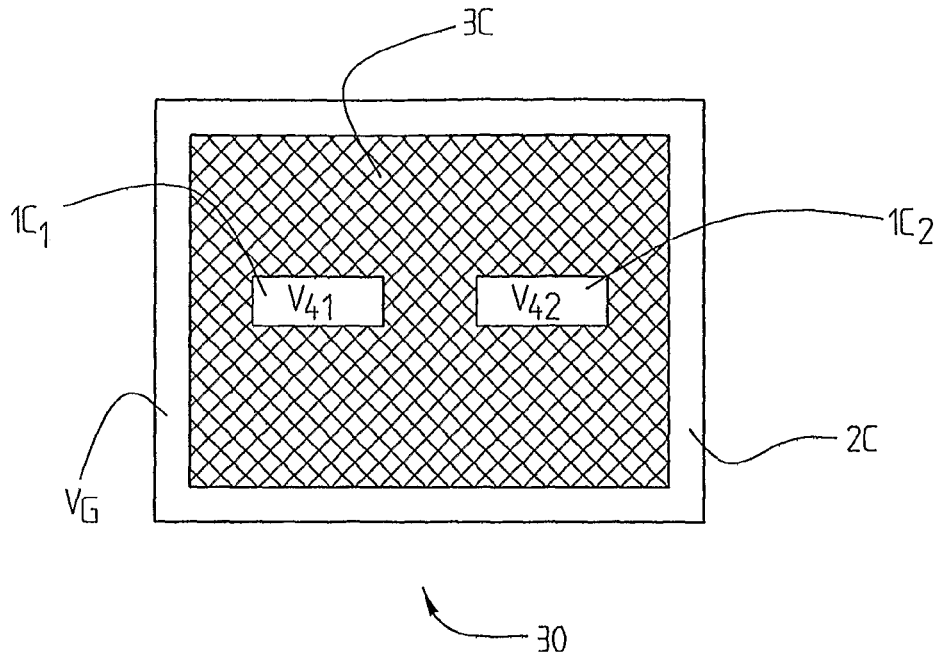
FIG. 5A is an illustration of a general implementation with a three-dimensional filling around not necessarily planar electrodes according to the inventive concept.

FIG. 5A schematically illustrates a general case in which two three dimensional high potential electrodes $C_1$, $C_2$ are provided having first high potentials $V_{41}$, $V_{42}$ respectively which may be different or the same. The resistive arrangement 2C is provided inside a three-dimensional box surrounding the three-dimensional or high potential electrodes. Here it is supposed that ground is the low potential.

Figure 5B:
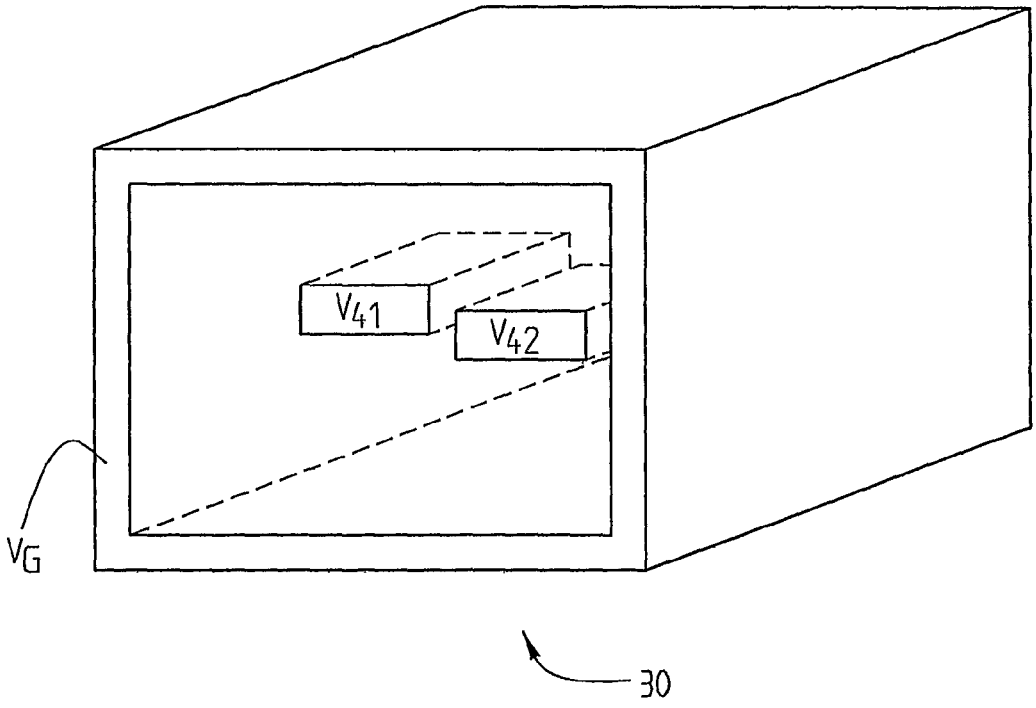
FIG. 5B is a 3D-view of the arrangement of FIG. 5A in perspective.

FIG. 5B is a schematical perspective view of the arrangement of FIG. 5A.

Figure 6:
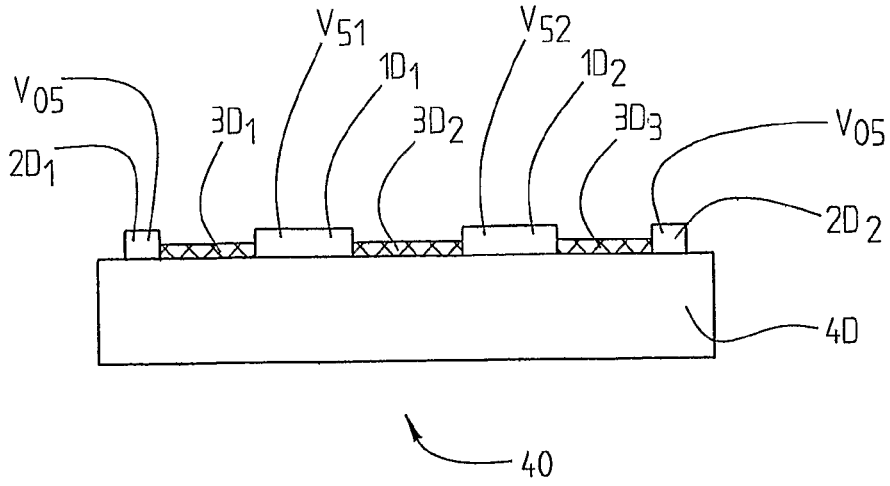
FIG. 6 shows an arrangement according to one embodiment in which two high potential electrodes with different potentials are disposed on a dielectric layer.

FIG. 6 shows another example of an implementation in which two high potential electrodes $\mathbf{1}D_1$, $\mathbf{1}D_2$ are provided on an arbitrary dielectric layer 4D. According to the inventive concept low potential electrodes $\mathbf{2}D_1$, $\mathbf{2}D_2$ are provided on respective external sides of the high potential electrodes and a resistive arrangement $\mathbf{3}D_1$, $\mathbf{3}D_2$, $\mathbf{3}D_3$ is provided between all electrodes. It is here supposed that the high potential electrodes $\mathbf{1}D_1$, $\mathbf{1}D_2$ have different potentials $V_{51}$, $V_{52}$ whereas the low potential electrodes are substantially grounded or have the same potential $V_{05}$. However, the high voltage electrodes can have different or even very different potentials (in absolute values) or differ only slightly and also the low potential electrodes may have different potentials. Alternatively the added electrodes may comprise balancing electrodes, e.g. of the opposite sign with respect to the high potential electrodes.

Figure 7:
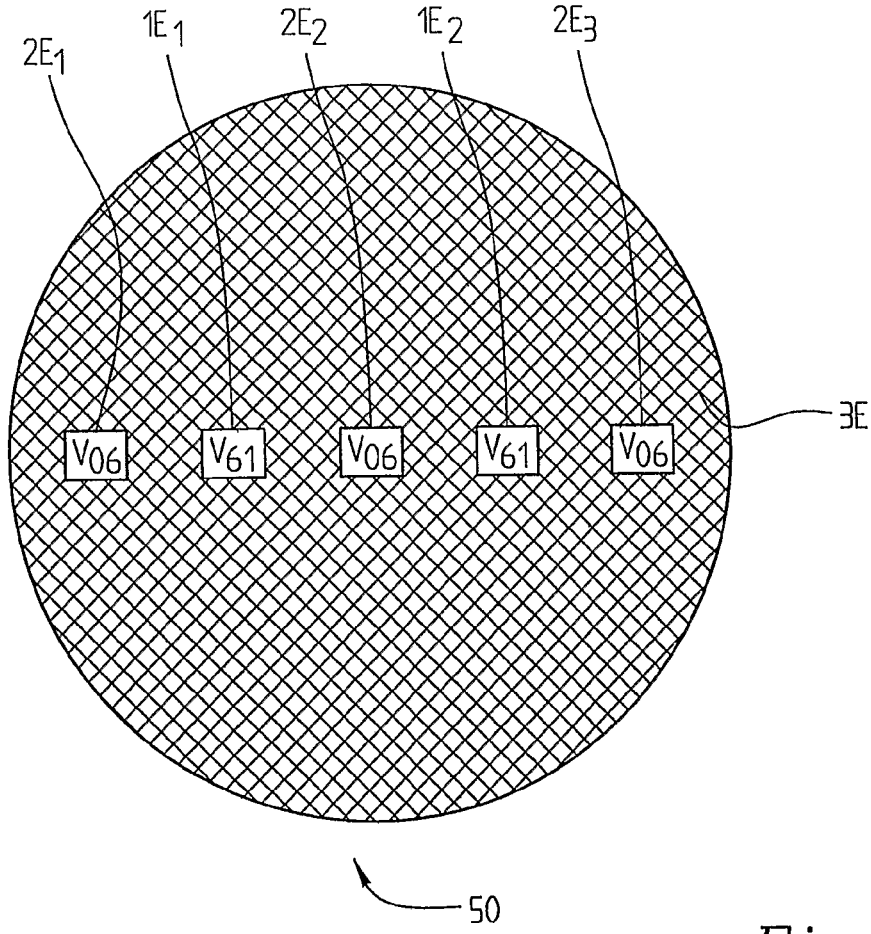
FIG. 7 is a top view of an embodiment of a circularly shaped arrangement with two high potential electrodes both having the same potential.

FIG. 7 schematically illustrates one example of a circular arrangement with two high potential electrodes $\mathbf{1}E_1$, $\mathbf{1}E_2$ which here have same potential $V_{61}$ and are disposed between the low potential electrodes $\mathbf{2}E_1$, $\mathbf{2}E_2$, $\mathbf{2}E_3$, here with the same potential $V_{06}$ which may be close to ground. The electrodes are also surrounded by a high resistivity arrangement 3E. It should be clear that also here there might be more high potential electrodes, only one high potential electrode, high potential electrodes with different potentials etc., and the low potential electrodes might comprise balancing electrodes.

Figure 8:
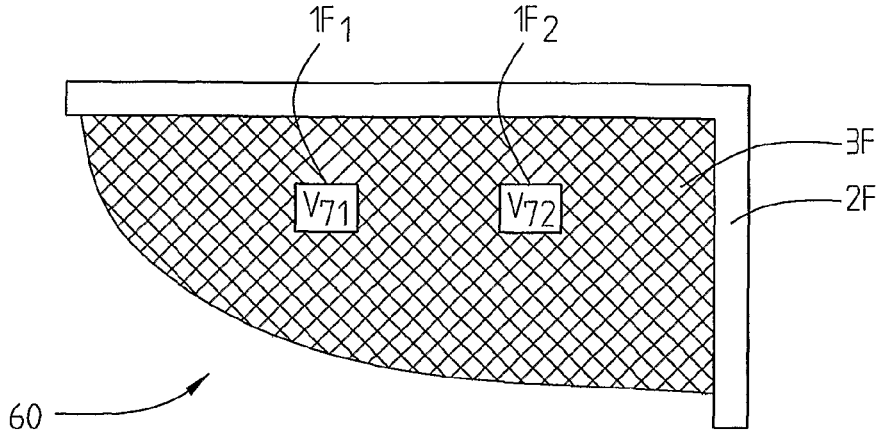
FIG. 8 is a schematical view of an arrangement with two high potential electrodes partly surrounded by a low potential arrangement.

FIG. 8 very schematically illustrates still an another implementation with two high potential electrodes 1$F_1$, 1$F_2$ with different potentials $V_{71}$, $V_{72}$ surrounded by a high resistivity arrangement 3F. In this case a low potential electrode arrangement 2F is provided which partly surrounds the electrodes in that it surrounds two outer sides of the second high potential electrode 1$F_2$ and one outer side of the high potential electrode 1$F_1$ and assumes the form of the outer edges of a half rectangle. It should be clear that also in this case there might be but one high potential electrode, more high potential electrodes, they might have different potentials or the same potentials etc.

Figure 9:
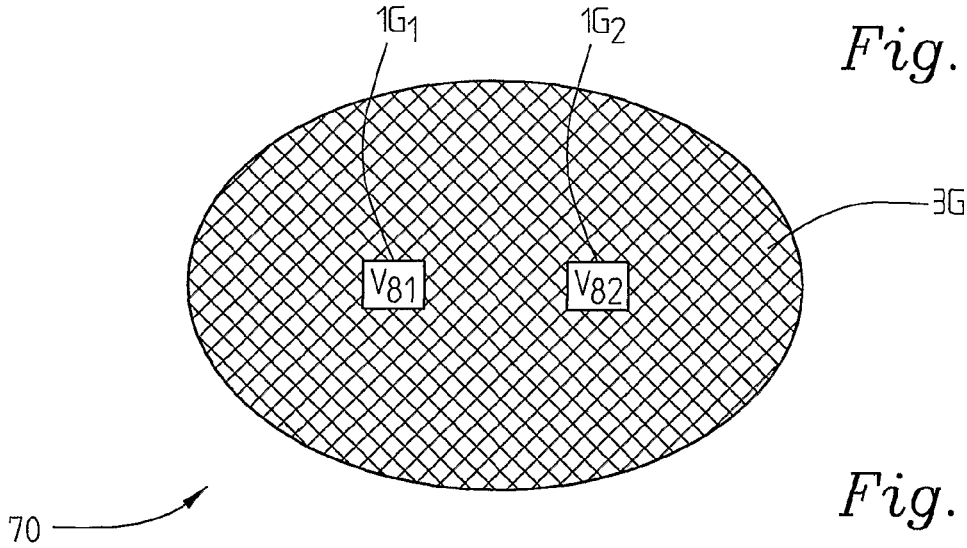
FIG. 9 is a top view of an ellipsoidally shaped arrangement where there are two high potential electrodes with two different potentials.

FIG. 9 illustrate an ellipsoidal implementation with two high potential electrodes 1$G_1$, 1$G_2$ with different potentials $V_{81}$, $V_{82}$ surrounded by a high resistivity arrangement 3G. In one embodiment the two high potential electrodes (presupposing more or less symmetrical conditions) one of which, here named the balancing electrode, such that the average of the potential will be close to ground. It is supposed that the resistive arrangement 3G is large compared to the electrodes. Then the outer edge of the resistive arrangement will experience a potential close to zero automatically, without surrounding electrode. Hence, one of the "high" potential electrodes is the balancing electrode for the other and vice versa. Of course it may also be surrounded by a low potential electrode (not shown).

Figure 10:
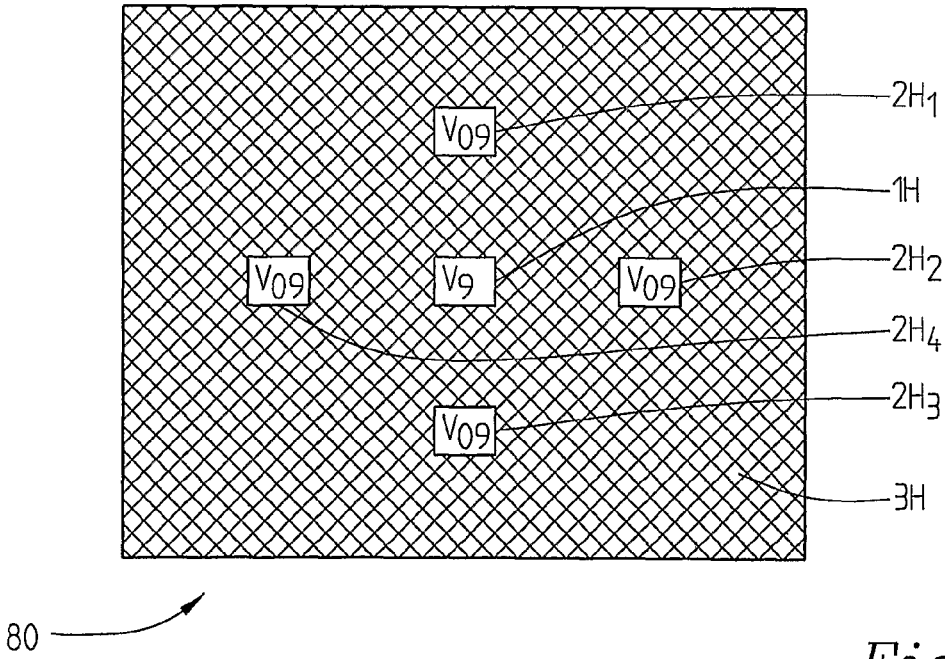
FIG. 10 is a top view of an arrangement with one high potential electrode which is surrounded by four low potential electrodes.

FIG. 10 very schematically illustrates still another implementation in which a high potential electrode 1H is surrounded on four sides by low potential (or balancing) electrodes 2$H_1$, 2$H_2$, 2$H_3$, 2$H_4$, all at a potential $V_{09}$. The high potential electrode is here supposed to have a potential $V_9$. Resistive arrangement 3H here surrounds all the electrodes. It might alternatively be provided only between the low potential electrodes 2$H_1$, . . . , 2$H_4$ and the high potential electrode 1H.

Figure 11A:
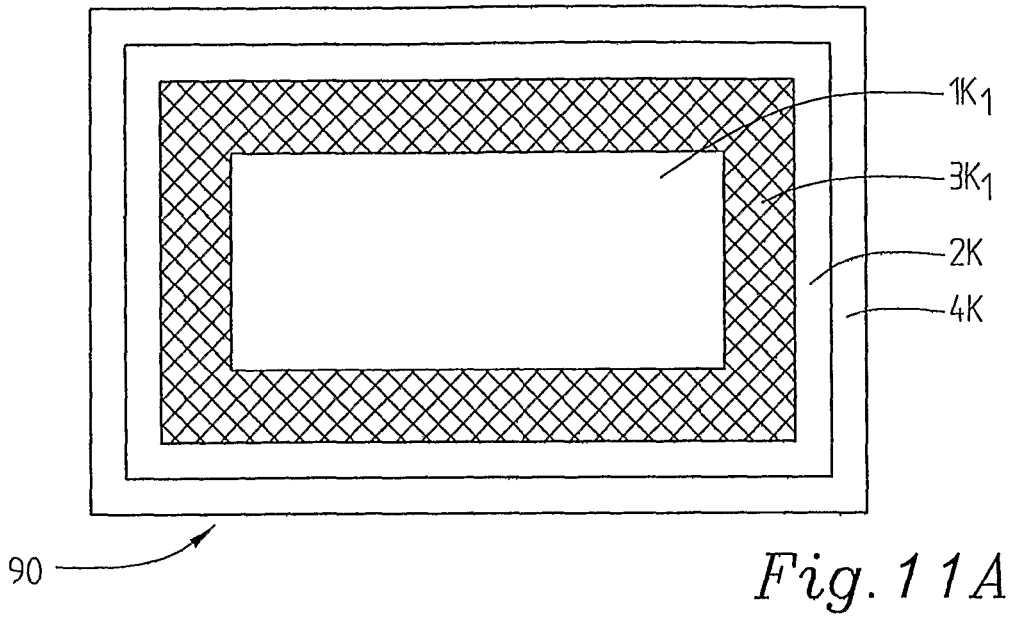
FIG. 11A is a top view of a multilayer arrangement with high voltage electrodes disposed on two sides of a dielectric layer (only the upper side shown in FIG. 11A)
Figure 11B:
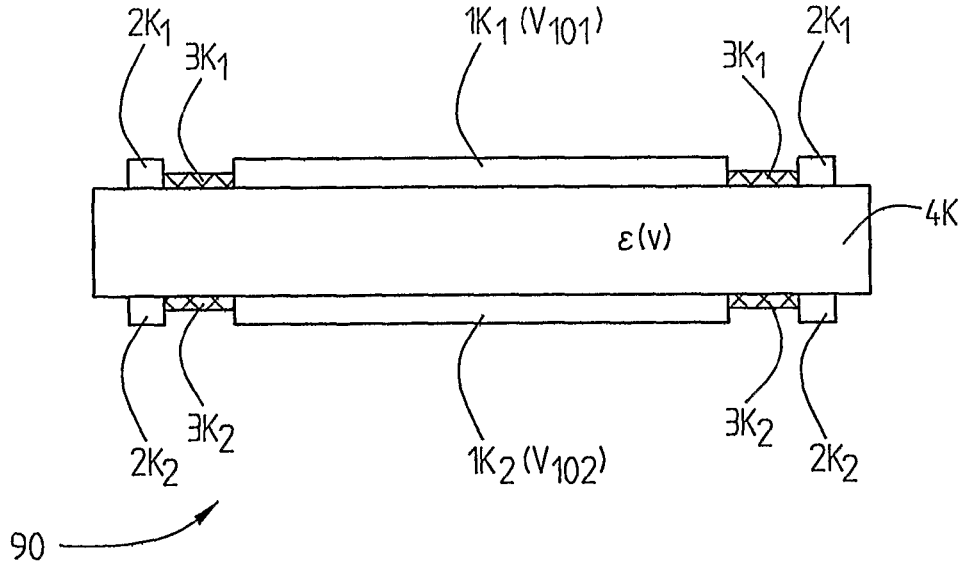
FIG. 11B is a cross-sectional view of the arrangement of FIG. 11A.

Finally FIG. 11A is a top view of an embodiment wherein a high potential electrode 1$K_1$ at a voltage $V_{101}$ is provided on top of a ferroelectric material, i.e. a tunable dielectric material 4K (cf. FIG. 11B) on the opposite side of which another high potential electrode 1$K_2$ (at $V_{102}$) is provided (cf. FIG. 11B). The high potential electrodes 1$K_1$, 1$K_2$ are surrounded by low resistivity arrangements 3$K_1$, 3$K_2$ and externally surrounded by low potential electrodes respectively. On the side where the first high potential electrode 1$K_1$ is provided, resistive arrangement 3$K_1$ is provided whereas at the opposite side, where the second high potential electrode 1$K_2$ is disposed, a resistive arrangement 3$K_2$ is provided. In this particular embodiment it is supposed that the ferroelectric layer 4K, or generally a substrate layer, is possible to penetrate with microwaves. In such an embodiment the high voltage electrode 1$K_1$ and the backside electrode 1$K_2$ should have a limited conductivity and thickness so that the microwaves are allowed to pass. This may be very useful in arrangements based on tuning of ferroelectrics. Hence it is supposed that the electrode material used for the high potential electrodes is a low microwave absorption electrode material. It is similar to the resistive film, but the resistivity is an order of magnitude lower. Of course any such material can be used.

It should be clear that the inventive concept is not limited to the explicitly illustrated embodiments but that it can be varied in a number of ways. For example it is possible to have strongly differing high potential electrodes close to one another, for example a very high potential electrode at for example 10000 V next to an electrode at a potential of −10000 V. In such an embodiment they could both be surrounded by low potential electrodes, or electrodes with a potential close to zero. Hence, a high potential electrode may here also mean an electrode provided at a very low (negative) potential and the concept is applicable to electrodes with very different potentials in which case a low potential electrode may be provided e.g. such as to surround partly or completely the electrode arrangement comprising one or more such electrodes or alternatively, or additionally, between all the respective electrodes and several variations are in principle possible, surrounding, partly surrounding, surrounding one side of a respective electrode. Hence, it should be clear that a resistive arrangement and the low potential electrodes can be disposed in many different ways with respect to high potential electrodes with the above mentioned meaning of high potential electrode or when there is a very big potential difference between two electrodes or components, low potential electrode(s) and a resistive arrangement may be arranged such as to surround or be provided inbetween or merely inbetween etc. However, if there is one high potential electrode (e.g. at approximately 8000 V or at approximately −8000 V), there may be provided a balance potential electrode at e.g. about −8000 V or +8000 V respectively, if symmetric, which means that the low potential electrode is replaced by a balance potential electrode, i.e. there is no need for a "low" potential electrode. It should also be clear that many different materials can be used in the resistive arrangement, the electrodes, a controllable layer or a substrate layer in general, only a few have been mentioned since it should be obvious to the man skilled in the art with knowledge of this document which other materials that could be used. Still further it should be clear that an arrangement according to the inventive concept can be implemented in many different components where field singularities or peak-fields may cause problems.

The invention claimed is:

1. An arrangement having at least one high potential electrode with a high potential in terms of absolute value and being adapted to be intentionally provided with a high potential or unintentionally being exposed to a high electrostatic field or a high potential, comprising:

at least one low potential electrode means or balancing potential electrode means, said low potential electrode means or balancing potential electrode means being provided at a distance from or in the vicinity of said at least one high potential electrode or surrounding, at least partly, said at least one high potential electrode, and at least one resistive arrangement substantially connecting each of said high potential electrode(s) with each respective adjacent low or balancing potential electrode means, said resistive arrangement(s) having a low conductivity and being non-isolating such that a substantially linear potential variation is provided between said high potential electrode(s) and said low or balancing potential electrode(s) to suppress peak-fields generated in the vicinity of any one of the high, low or balancing potential electrode(s);

wherein the high potential electrode or electrodes is/are provided on a dielectric layer; and wherein the dielectric layer has a variable dielectric constant.

2. The arrangement according to claim 1, wherein the dielectric layer comprises a ferroelectric layer.

3. The arrangement according to claim 1, wherein said arrangement is coupled to electric control means comprising a voltage generating or applying means adapted to apply an electric field to the ferroelectric layer to control the dielectric constant.

4. The arrangement according to claim 1, wherein the high potential electrode(s) and the low potential electrode(s) or the balancing potential electrode(s) and the resistive arrangement are provided on a ferroelectric layer with a controllable dielectric constant.

5. The arrangement according to claim 1, said arrangement comprising a planar structure with the high potential electrode(s), the low or the balancing potential electrode(s).

6. The arrangement according to claim 5, said arrangement comprising a dielectric or ferroelectric layer.

7. The arrangement according to claim 6, wherein the ferroelectric material comprises a ceramic material such as a BST material.

8. The arrangement according to claim 1, the arrangement comprising two or more high potential electrodes.

9. The arrangement according to claim 8, wherein the at least two high potential electrodes have at least two different potentials.

10. The arrangement according to claim 1, wherein the resistive arrangement comprises a high resistivity film.

11. The arrangement according to claim 10, wherein the high resistivity film comprises a resistive thick film.

12. The arrangement according to claim 11, wherein the resistive thick film is a screen printed $SrTiO_3$ and $LaMnO_3$.

13. The arrangement according to claim 1, wherein the resistive arrangement comprises leakage currents enabled to flow in the electrically tunable dielectric layer or in a surrounding silicone material or in an isolation fluid.

14. The arrangement according to claim 1 wherein the resistive arrangement has a sheet resistance of the order 1-10, 000 MOhm/square.

15. The arrangement according to claim 14, wherein the resistive arrangement has a resistivity or sheet resistance of about 50-150, particularly about 100 MOhm/square.

16. The arrangement according to claim 1, wherein the resistive arrangement comprises a thin film.

17. The arrangement according to claim 16, wherein the resistive thin film comprises one from the group consisting of Nichrome (NiCr), Cr and Ta.

18. The arrangement according to claim 1, wherein the arrangement is a thick film arrangement, or a three-dimensional arrangement.

19. The arrangement according to claim 18, wherein the resistive arrangement has a thickness of about 5-10 μm and in that the electrodes have a thickness of about 10 μm and are disposed on a dielectric layer with a thickness of approximately 0.5-10 μm.

20. The arrangement according to claim 1, the arrangement being planar.

21. The arrangement according to claim 20, further comprising planar electrodes and a planar dielectric layer or a planar substrate layer.

22. The arrangement according to claim 1, wherein the resistive arrangement is arranged to surround the high potential electrodes.

23. The arrangement according to claim 1, wherein the resistive arrangement is provided between the high potential electrode(s) and the low or balancing potential electrode(s).

24. The arrangement according to claim 1, wherein the high potential and low or balancing potential electrodes are located on both of two opposite sides of an electrically tunable dielectric layer.

25. The arrangement according to claim 1, wherein the high potential electrode or electrodes is/are provided on a dielectric layer and further wherein the ground electrode is provided on a side of a dielectric or a ferroelectric layer which is opposite to the side on which the high and low or balancing potential electrodes are provided.

26. The arrangement according to claim 1 further comprising a circular, oval, square shaped, rectangular or ellipsoidal planar or three-dimensional extension.

27. The arrangement according to claim 1, wherein the high and/or low and/or balancing potential electrode or electrodes are encapsulated in silicon or immersed in an isolation fluid.

28. The arrangement according to claim 1, wherein the high and/or low or balancing potential electrodes are printed or sputtered/plated and etched on a dielectric, e.g. ferroelectric substrate.

29. The arrangement according to claim 1, wherein the at least one high potential electrode is disposed at a distance from any other electrode of approximately 0.1-10 mm when using thick film processing or at a distance of a 3-30 μm when using thin film processing, including processing on semiconductor substrates.

30. The arrangement according to claim 1, wherein the high potential electrode(s) and/or the low potential electrode (s) and/or the balancing potential electrode(s) has/have sharp edges.

31. The arrangement according to claim 1, for use in a ferroelectricum based phase shifter, filter, matching circuit, controllable antenna, or power splitter.

* * * * *